US005689282A

United States Patent [19]

Wolfs et al.

[11] Patent Number: 5,689,282

[45] Date of Patent: Nov. 18, 1997

[54] DISPLAY DEVICE WITH COMPENSATION FOR STRAY CAPACITANCE

[75] Inventors: Peter B. A. Wolfs; Karel E. Kuijk, both of Eindhoven, Netherlands

[73] Assignee: U.S. Philips Corporation, New York, N.Y.

[21] Appl. No.: 898,985

[22] Filed: Jun. 15, 1992

[30] Foreign Application Priority Data

Sep. 7, 1991 [EP] European Pat. Off. ..... 91201789

[51] Int. Cl.[6] ..... G09G 3/36

[52] U.S. Cl. ..... 345/100; 345/96; 345/103

[58] Field of Search ..... 340/784, 805; 359/55, 68; 345/91, 150, 99, 103, 208, 96

[56] References Cited

U.S. PATENT DOCUMENTS 4,317,115 2/1982 Kawakami et al. ..... 340/805

4,602,292 7/1986 Togashi et al. ..... 340/784

4,745,406 5/1988 Hayashi et al. ..... 340/784

5,144,288 9/1992 Hamada et al. ..... 359/68

FOREIGN PATENT DOCUMENTS 0295802 12/1988 European Pat. Off. .

0479552 4/1992 European Pat. Off. .

*Primary Examiner*—Kee M. Tung

*Assistant Examiner*—Matthew Luu

[57] ABSTRACT

When an active matrix LCD is driven while using inversion per n rows (n≧2), stripe effects occur. In the case of double line inversion this leads to stripes in the picture. This can be largely obviated by supplying a different selection voltage to at least the last row of the rows in a group of n rows.

16 Claims, 2 Drawing Sheets

DISPLAY DEVICE WITH COMPENSATION FOR STRAY CAPACITANCE

BACKGROUND OF THE INVENTION

This invention relates to a display device comprising a system of pixels arranged in rows and columns and a line selection circuit which, during operation, can select rows of pixels by means of selection voltages. The device also comprises a circuit for presenting column or data voltages during selection.

A display device of this type is suitable for displaying alpha-numerical information and video information by means of passive electro-optical display media such as liquid crystals, electrophoretic suspensions and electrochromic materials.

A display device of the type described in the opening paragraph is known from European Patent Application no. 0 299 546, which corresponds to U.S. Pat. No. 5,032,831 (Jul. 16, 1991). This application and patent describes a drive mode which makes it possible to change the pixels such that pixels in consecutive rows are charged to the opposite polarity (single row inversion) and the polarity in different frames is inverted (frame inversion), while there is a considerable freedom of choice as regards the form of colour filters which may be used.

When using some colour filters, it may be advantageous to invert the polarity, for example, after driving every two rows (double row inversion) instead of one row. Asymmetries in picture electrodes or technical reasons regarding layout may also give rise to a repetition of certain patterns after, for example, four rows so that it may be favourable to repeat the inversion after every four rows or, more generally, after m rows.

When such display devices are used, stripes are usually visible along the edge of the groups of rows. In the case of double row inversion this becomes manifest in light rows alternating with dark ones.

SUMMARY OF THE INVENTION

The present invention has, inter alia, for its object to provide a display device in which said stripe effects are reduced considerably.

To this end a display device according to the invention is characterized in that the line selection circuit can select consecutive rows of pixels within groups of at least two rows of pixels during operation and charges consecutive groups of pixels in the opposite sense, the line selection circuit being capable of applying a selection voltage to at least one row electrode or selection electrode at the beginning or the end of a group of rows during operation, which selection voltage differs from the other selection voltages within the group.

The invention is based on the recognition that said stripe effects are mainly due to capacitive couplings between consecutive rows.

In the ease of such an inversion after, for example, m rows the first row of pixels in a subsequent group is charged in the opposite sense with respect to the pixels in the previous group. This effect can be corrected to some extent by adapting the selection voltages at one side or at both sides at the transition of a group of pixels to a subsequent row. Since the correction also depends on the capacitance of the pixel, which in its turn depends on the setting of this pixel on the transmission/voltage characteristic curve, the correction is preferably performed for a pixel capacitance which corresponds to a setting halfway the transmission/voltage characteristic curve (medium grey).

The invention is notably suitable for colour display devices using a colour filter whose colour pixels of one and the same colour in consecutive rows are shifted with respect to each other by one or more columns. In the case of single row inversion similar colour pixels would always be charged in the same direction, so that crosstalk of the column signal via the capacitive division of the capacitances of the pixel and of a non-linear switching element (diode, MIM) may have a detrimental effect (notably in larger areas of one and the same colour). By division into groups of two (double row inversion), with the possible exception of rows at the edge (of the display), this crosstalk problem (between columns and rows) is largely solved, but a capacitive coupling between the row electrodes becomes visible in the form of said stripe effects. The adaptation, according to the invention, of the selection voltages reduces the occurrence of these stripes.

The picture electrodes may be switching units consisting of one or more active switching elements. The switching elements may be two-poles (for example, diodes, MIMs) or three-poles (for example, thin-film transistors (TFTs)).

BRIEF DESCRIPTION OF THE DRAWING

The invention will now be described in greater detail with reference to some embodiments and the drawing in which:

FIG. 4 shows diagrammatically a part of the display device according to the invention and FIGS. 5*a*, 5*b* and 5*c* show equivalent circuit diagrams, with respect to which aspects of the invention will be described, while

DESCRIPTION OF THE PREFERRED EMBODIMENTS

Figure 1:
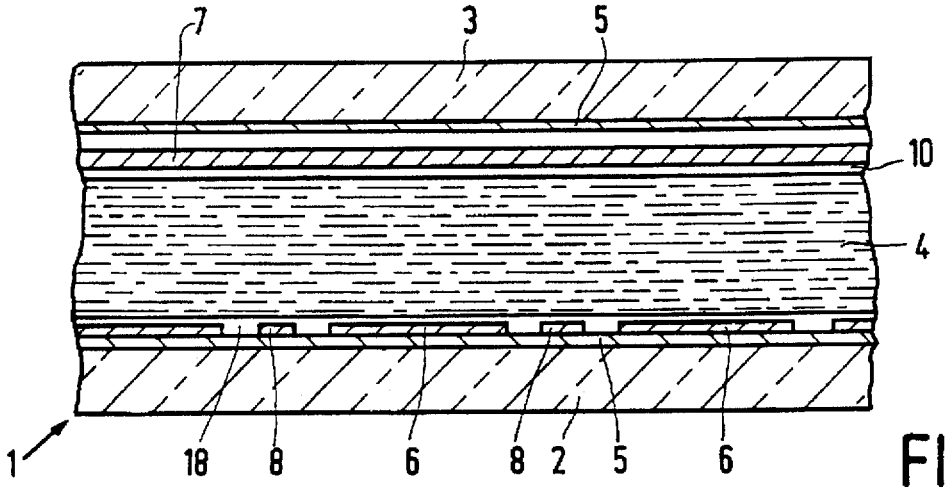
FIG. 1 is a cross-sectional view of a display device embodying the invention.

FIG. 1 shows in a diagrammatic cross-section a part of a display device, in this embodiment a liquid crystal display device 1, comprising two supporting plates 2 and 3 between which, for example, a twisted nematic liquid crystalline material 4 is present. The inner surfaces of the supporting plates 2 and 3 are provided with electrically and chemically insulating layers 5. A number of row and column-arranged picture electrodes 6 of indium-tin oxide or another electrically conducting transparent material is provided on the supporting plate 2. Transparent picture electrodes 7 of, for example, indium-tin oxide which are integrated to strip-shaped electrodes (in this embodiment column electrodes) are also provided on the supporting plate 3. The facing picture electrodes 6, 7 constitute the pixels of the display device.

Strip-shaped (for example, metal) row electrodes 8 are arranged between the rows of picture electrodes 6. Each picture electrode 6 is connected to a row electrode 8 via a switching element (not shown). Furthermore, liquid crystal orienting layers 10, 18 are provided on the inner surfaces of the supporting plates 2 and 3. As is known, a different orientation state of the liquid crystal molecules and hence an optically different state can be obtained by applying a voltage across the liquid crystal layer 4. The display device can be realised as a transmissive or a reflective device and may have one or two polarizers.

Figure 2:
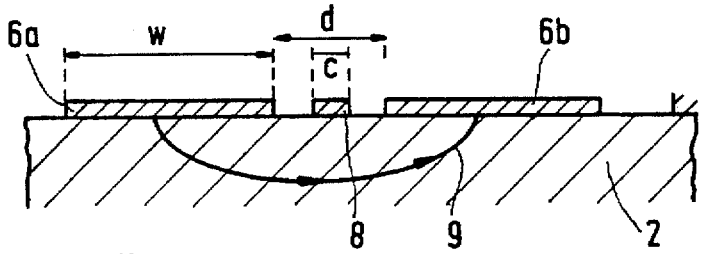
FIG. 2 shows a part of FIG. 1 on a larger scale.

In FIG. 2 the cause of the capacitive coupling will be further explained. A stray capacitance $C_c$, which is diagrammatically illustrated by means of the field line 9, is produced via the substrate 2 of, for example, glass. The picture electrode $\mathbf{6}^a$ associated with the first pixel $\mathbf{11}^a$ receives a voltage of, for example, $-V_c$ after selection. If the picture electrode $\mathbf{6}_b$ associated with the next pixel also receives a voltage $-V_c$ in a subsequent selection period after it has received a voltage of $+V_c$ in a previous (frame or field) period (the transmission value of juxtaposed pixels, notably in large areas, is often closely correlated), the voltage across the picture electrode $\mathbf{6}^b$ changes from $+V_c$ to $-V_c$. Such a voltage variation of $2V_c$ of this picture electrode causes a voltage variation via the capacitance $C_c$ across the pixel associated with picture electrode $\mathbf{6}^a$ by a value of $\Delta V=(C_c/(C_p+C_c+C_m))*2V_c$, or roughly $(C_c/C_p)*2V_c$. $C_p$ is the capacitance of the pixel and $C_m$ is the capacitance of the non-linear switching element (see also FIG. 5).

The absolute value of the voltage across the first picture electrode increases when the second picture electrode is charged in the same direction and the first pixel becomes darker (based on a twisted nematic liquid crystal effect between crossed polarizers). However, if a third, subsequent pixel receives an opposite charge, the absolute value of the voltage across the second pixel will be smaller than is intended so that this pixel becomes lighter. In the case of double row inversion the first row of each pair of rows in which the pixels are charged in the same direction becomes darker and the second row becomes lighter than is intended. In the case of inversion after a larger numbers of rows this effect always occurs around the last row of the blocks into which the rows have been divided.

Figure 3A:
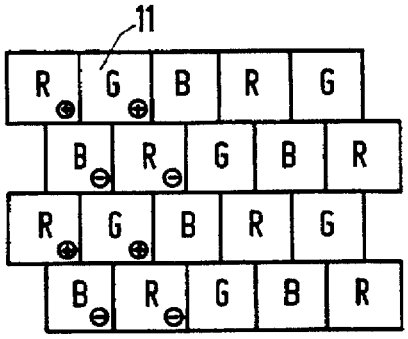
FIG. 3*a* is a diagrammatic plan view of a colour filter, with reference to which the above-mentioned problems occurring in the case of single row inversion are explained.

FIG. 3*a* is a diagrammatic plan view of a plurality of pixels 11 of a colour display device with a colour filter whose colour elements (corresponding to pixels) in juxtaposed rows are shifted with respect to each other over half a pitch. When single row inversion is used, in which the above-mentioned capacitive crosstalk is largely corrected in monochrome display devices, pixels of the same colour in one column are always charged with the same sign. In FIG. 3*a* this is denoted by means of a + or a − sign. Since, for example, consecutive red pixels in the same column are always charged in the same direction, crosstalk via the capacitive division of the capacitances associated with the non-linear switching element and the pixel (having a value of $$\frac{C_m}{C_m+C_p+C_c}\,\Delta V_k$$

$\Delta V_k$: voltage sweep on the column) causes a setting on the transmission/voltage characteristic curve which gives a too high or too low transmission for a given colour in one column.

Figure 3B:
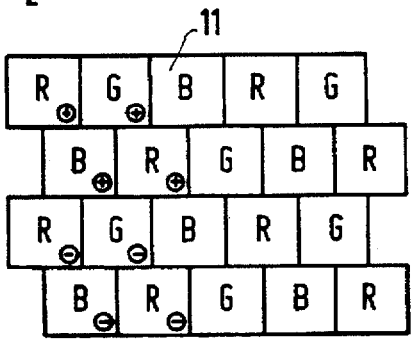
FIG. 3*b* is a diagrammatic plan view of a similar colour filter, with reference to which the invention will be further described.

In the case of double row inversion (FIG. 3*b*) successive pixels of one and the same colour in the same column are charged in the opposite sense, but now the capacitive coupling of the rows produces the above-mentioned stripe effect. According to the invention this can at least partly be obviated by the choice of the row or selection voltages.

This will be further explained with reference to FIG. 4. The display device shown in this Figure comprises a plurality of pixels 11 arranged in rows and columns which are driven via switching elements 12, for example, MIMs (metal-isolator-metal). By successively selecting (energizing) row electrodes 8, information which is present on the column electrodes 7 is presented to the pixels 11. Row electrodes 8 are consecutively selected by means of, for example, a row selection circuit 13, while the information to be presented for a selected row of pixels is stored in a register 14. The assembly is driven and synchronized by means of the switching unit 15. In this embodiment the rows are divided into groups of two, with the possible exception of the first and the last row, i.e. a display device comprising n rows of pixels is then divided into at least (n−2)/2 groups of two rows of pixels.

Figure 4:
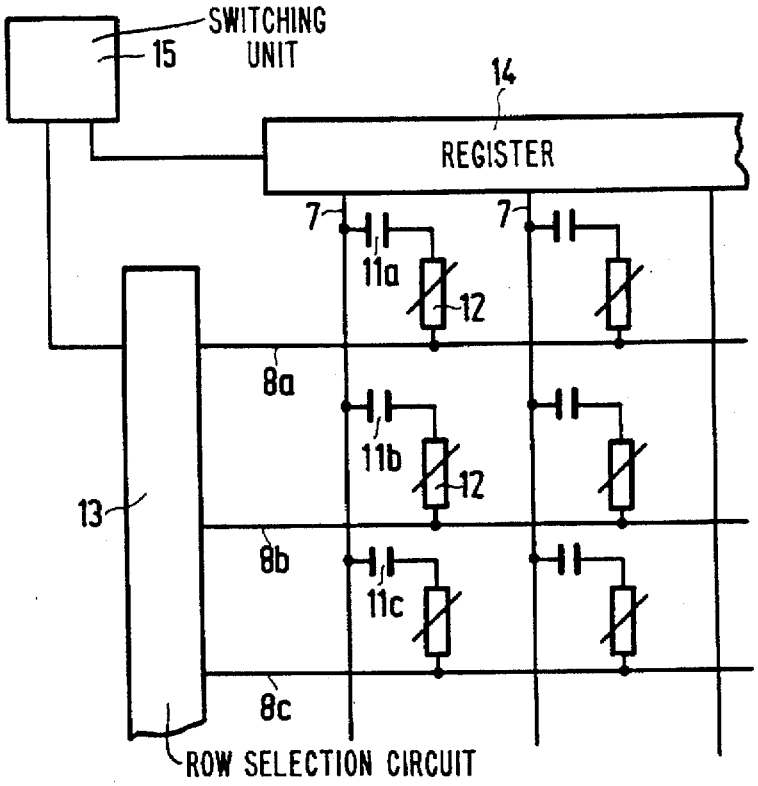
Figure 5A:
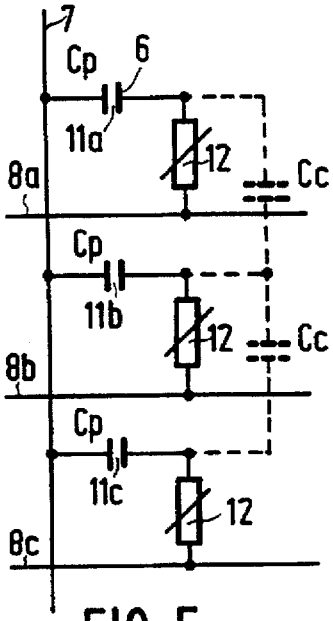

FIG. 5*a* shows a part (three pixels) of the device of FIG. 4 in which the stray capacitance $C_c$ is shown by means of broken lines. If the pixels $\mathbf{11}^a$ and $\mathbf{11}^b$ are consecutively charged positively (double line inversion) by means of selection voltages on the row electrodes $\mathbf{8}^a$, $\mathbf{8}^b$ and if subsequently pixel $\mathbf{11}^c$ is charged negatively by selecting row electrode $8^c$, the voltage across pixel $\mathbf{11}^b$ is decreased. According to the invention this is prevented by choosing the selection voltage across the row electrode $\mathbf{8}^a$ (hence $8^c$. . . ) to be lower, or by choosing the voltage across the row electrode $\mathbf{8}^b$ to be higher; a combination is alternatively possible. In the relevant embodiment in which the row electrodes are divided into groups of two the selection voltages within each group of two are thus different. The correction to be set is also dependent on the setting on the transmission/voltage characteristic curve and is preferably set at a value halfway this characteristic curve (medium grey).

Figure 6:
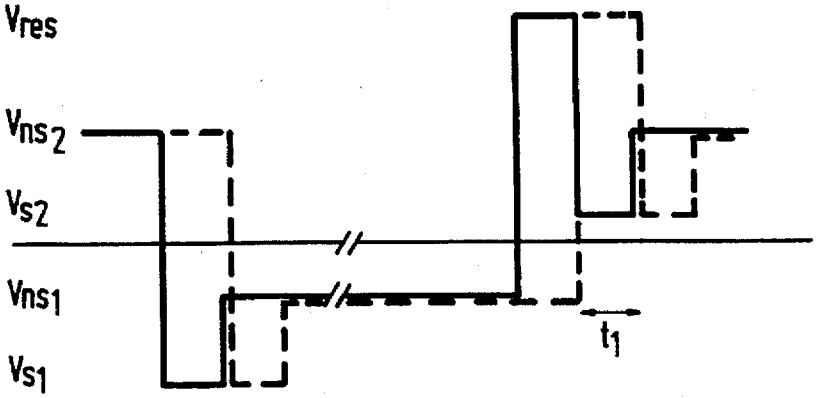
FIG. 6 shows a part of the row signals for one of the drive modes.

The device of FIG. 4 can also be driven by means of the method as described in EP-A-0 362 939 (PHN 12.698) which is hereby incorporated by reference. FIG. 6 shows diagrammatically the associated selection signals (5-level drive) for two successive rows. If a row is charged positively, which corresponds to a selection voltage $V_{s1}$ in FIG. 6, the variation of the voltage across picture electrode 6 (medium grey) is $-2V_c=-(V_{sat}+V_{th})$ (this value also applies to the previous example; $V_{sat}$: saturation voltage, $V_{th}$: threshold voltage), which corresponds to a negative feedback to the picture electrode in the previous row. If the row is charged negatively, the reset voltage $V_{res}$ is first applied to a row electrode. This does not have any influence on the picture electrode in the previous row because this row receives a selection voltage $V_{s2}$ at that moment and consequently the non-linear switching element is still conducting (time interval t1 in FIG. 6). Picture electrode 6 is charged to a voltage of at least $V_{sat}+\frac{1}{2}(V_{sat}-V_{th})$ at the end of the reset period. At the end of the next selection period the voltage (in the case of medium grey) is $\frac{1}{2}(V_{sat}+V_{th})$ resulting in a net variation of $\geqq-(V_{sat}-V_{th})$ across the picture electrode in the previous row. This negative feedback is smaller than in the case of 4-level drive so that the selection voltages are chosen to be slightly different than in the previous embodiment in which the feedback has substantially the same value in both cases.

Figure 5B:
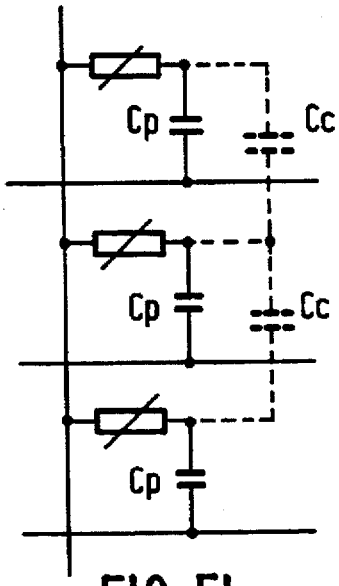
Figure 5C:
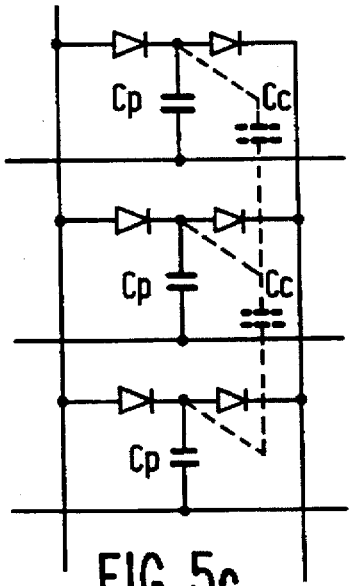

For the devices of FIG. 5*b* and 5*c* slightly different considerations are used with respect to the values of the voltage variations across the picture electrodes, but here again stripe effects can be largely prevented by adapting one or more selection voltages within a group of rows in the case of double row inversion, or more generally, inversion after m rows.

The invention is of course not limited to the embodiments described but several variations are possible within the scope of the invention. The stray capacitance, which causes said capacitive coupling between the rows, does not only exist in devices with two-poles as shown in the Figures but also in active pixels based on three-poles such as TFTs so that the invention is also applicable in this field. In the case of a division of the rows into larger groups the stray capacitance to a picture electrode which is further remote may be taken into account, if necessary, in the adaptation of the selection voltages.

We claim:

1. A display device comprising: a system of pixels arranged in rows and columns, a line selection circuit coupled to the pixels via a system of row electrodes and which, during operation, selects rows of pixels by means of selection voltages applied to the rows of pixels via the row electrodes, and a circuit for presenting, via a system of column electrodes, column or data voltages to the pixels during row selection, characterized in that the line selection circuit selects in sequence consecutive rows of pixels within groups of at least two rows of pixels during operation and charges consecutive groups of pixels in the opposite sense, and wherein the line selection circuit applies a selection voltage to at least one row electrode or selection electrode at the beginning or the end of a group of rows during operation, which selection voltage differs from the other selection voltages applied within said group of rows.

2. A display device as claimed in claim 1, which further comprises a colour filter whose colour pixels of one and the same colour in consecutive rows of pixels are shifted with respect to each other by one or more columns.

3. A display device as claimed in claim 2, wherein the rows of pixels are divided into groups of two, except for the first and the last row of pixels.

4. A display device as claimed in claim 3, wherein the picture electrodes forming the pixels are connected to the row electrodes or to column electrodes via active switching units.

5. A display device as claimed in claim 4, wherein the active switching unit comprises one or more two-pole or three-pole elements.

6. A display device as claimed in claim 1, wherein the rows of pixels are divided into groups of two.

7. A display device as claimed in claim 6, wherein picture electrodes forming the pixels are connected to the row electrodes or to column electrodes via active switching units.

8. A display device as claimed in claim 1, wherein picture electrodes forming the pixels are connected to the row electrodes or to column electrodes via active switching units.

9. A display device as claimed in claim 2, wherein picture electrodes forming the pixels are connected to the row electrodes or to column electrodes via active switching units.

10. A display device as claimed in claim 8, wherein the active switching unit comprises one or more two-pole or three-pole elements.

11. A display device comprising:

an electro-optical display medium disposed between two supporting plates, a system of pixels comprising picture electrodes arranged in rows and columns on at least one of said supporting plates, a system of row and column electrodes for presenting selection and data signals to said pixels for the purpose of picture display, a circuit for presenting data signals to said column electrodes during each row selection period, and a row selection circuit for applying selection voltages to the pixels for selecting rows of pixels consecutively within groups of at least two rows of pixels and wherein said selection voltages are inverted at least after every two rows of pixels, whereby pixels of consecutive groups are charged to voltages of opposite polarity and the rows of pixels in each group are selected consecutively, the selection voltage applied to at least one row electrode of a group of rows being different from other selection voltages applied to row electrodes within said group of rows.

12. A display device as claimed in claim 11 further comprising a color filter providing color pixels arranged in rows and columns wherein color pixels of the same color in two consecutive rows are shifted with respect to one another so that they form different columns of the same color electrodes.

13. A display device as claimed in claim 12 wherein, during a given field period, the colour pixels of two consecutive rows of pixels are charged to the same polarity and the colour pixels of the next two consecutive rows of pixels are charged to the opposite polarity to that of the first two consecutive rows of pixels.

14. A display device as claimed in claim 11 wherein the rows of pixels are divided into groups of two rows of pixels.

15. A display device as claimed in claim 11 further comprising active switching elements coupling the picture electrodes to at least one system of the row or column electrodes, and wherein the selection voltages applied to the rows of pixels are of a value to substantially compensate for stray capacitance between picture electrodes of consecutive rows of pixels.

16. A display device as claimed in claim 11 wherein the row selection circuit selects the rows one row at a time and inverts the polarity of the row selection voltages every n rows ($n \geqq 2$), and said different selection voltage is applied to the last row in a group of n rows.

* * * * *